US010627745B2

(12) United States Patent
Deprez et al.

(10) Patent No.: US 10,627,745 B2
(45) Date of Patent: Apr. 21, 2020

(54) DIGITAL PRINTING APPARATUS AND PROCESSING USING LIQUID TONER

(71) Applicant: Xeikon Manufacturing N.V., Lier (BE)

(72) Inventors: Lode Erik Dries Deprez, Wachtebeke (BE); Werner Jozef Johan Op de Beeck, Putte (BE); Wouter Jeroom Maria Van Gaens, Wilrijk (BE)

(73) Assignee: Xeikon Manufacturing N.V., Lier (BE)

( * ) Notice: Subject to any disclaimer, the term of this patent is extended or adjusted under 35 U.S.C. 154(b) by 0 days.

(21) Appl. No.: 16/096,437

(22) PCT Filed: Apr. 25, 2017

(86) PCT No.: PCT/EP2017/059809
§ 371 (c)(1),
(2) Date: Oct. 25, 2018

(87) PCT Pub. No.: WO2017/186724
PCT Pub. Date: Nov. 2, 2017

(65) Prior Publication Data

US 2019/0146377 A1 May 16, 2019

(30) Foreign Application Priority Data

Apr. 29, 2016 (NL) ..... 2016696

(51) Int. Cl.
*G03G 15/10* (2006.01)
*G03G 15/20* (2006.01)
(Continued)

(52) U.S. Cl.
CPC ..... *G03G 15/104* (2013.01); *G03G 13/013* (2013.01); *G03G 13/18* (2013.01);
(Continued)

(58) Field of Classification Search
CPC .... G03G 9/125; G03G 15/10; G03G 15/2007; G03G 15/201
(Continued)

(56) References Cited

U.S. PATENT DOCUMENTS 5,108,865 A 4/1992 Zwaldo et al.
7,184,698 B2 2/2007 Tombs
(Continued)

FOREIGN PATENT DOCUMENTS

EP 0453256 A2 10/1991
EP 0455343 A1 11/1991
(Continued)

*Primary Examiner* — Walter L Lindsay, Jr.
*Assistant Examiner* — Jessica L Eley
(74) *Attorney, Agent, or Firm* — The Webb Law Firm

(57) ABSTRACT

A digital printing process for xerography printing with liquid toner is disclosed, said liquid toner including a curable carrier liquid and imaging particles suspended in the carrier liquid. The process includes: forming a latent image as a pattern of electric charge on a surface of an imaging member; transferring the liquid toner onto a development member; developing the latent image by transferring liquid toner from the development member onto the imaging member in accordance with the pattern; transferring the liquid toner from the imaging member to a first substrate; applying a second substrate on the transferred liquid toner; after application of the second substrate, irradiating the liquid toner with actinic radiation or particle beams to cure the carrier liquid.

20 Claims, 4 Drawing Sheets

(51) Int. Cl.
*G03G 15/00* (2006.01)
*G03G 13/01* (2006.01)
*G03G 13/18* (2006.01)

(52) U.S. Cl.
CPC ..... *G03G 15/10* (2013.01); *G03G 15/2007* (2013.01); *G03G 15/6591* (2013.01)

(58) Field of Classification Search
USPC ..... 347/102
See application file for complete search history.

(56) References Cited

U.S. PATENT DOCUMENTS 8,231,214 B2 * 7/2012 Roof ..... B41J 11/002 347/102
8,501,381 B2 8/2013 Humpert et al.
8,628,177 B2 * 1/2014 Barton ..... B41J 11/002 347/84
8,871,861 B2 10/2014 Shoshi et al.
2005/0202164 A1 * 9/2005 Stelter ..... G03G 15/09 427/180
2008/0218570 A1 * 9/2008 Kovacs ..... C09D 11/101 347/88
2011/0113976 A1 5/2011 Thompson
2011/0236652 A1 9/2011 Nakamura et al.
2012/0251174 A1 * 10/2012 Shirai ..... G03G 15/0189 399/132
2013/0315641 A1 11/2013 Watanabe et al.
2014/0199531 A1 * 7/2014 Pervan ..... B44C 1/24 428/207
2016/0243870 A1 8/2016 Fu et al.

FOREIGN PATENT DOCUMENTS

EP 1725913 11/2006
EP 1973003 A1 9/2008
EP 2348363 A1 7/2011
EP 2520579 A2 11/2012
WO 2015069255 A1 5/2015

* cited by examiner

DIGITAL PRINTING APPARATUS AND PROCESSING USING LIQUID TONER

CROSS-REFERENCE TO RELATED APPLICATIONS

This application is the United States national phase of International Application No. PCT/EP2017/059809 filed Apr. 25, 2017, and claims priority to Dutch Patent Application No. 2016696 filed Apr. 29, 2016, the disclosures of which are hereby incorporated in their entirety by reference.

FIELD OF INVENTION

The field of the invention relates to digital printing apparatus and processes using liquid toner comprising carrier liquid and imaging particles.

BACKGROUND

Prior art digital printing apparatus using liquid toner typically comprise an image forming unit with an imaging member adapted to sustain a pattern of electric charge forming a latent image on its surface, a development member arranged to receive liquid toner, and to develop said latent image by transferring a portion of said liquid toner onto the imaging member in accordance with said pattern. The liquid toner is then applied from the imaging member on the substrate, optionally via an intermediate member.

It is known to apply coatings on printed toner images to reduce the sensitivity to rubbing and/or to improve the gloss. However, such embodiments have the disadvantage that a separate coating unit is needed resulting in an increase of the cost of the printing process.

EP 0 455 343 discloses a liquid toner comprising a curable carrier liquid. It is claimed that by curing the curable carrier liquid after printing the adhesion of the image to the substrate is improved, since the carrier liquid can penetrate in the substrate, and curing results in the image being tightly bound to the fibres of the substrate. Such an embodiment may work for porous substrates, where a surface layer of the carrier liquid is exposed using UV light.

SUMMARY

The object of embodiments of the invention is to provide a digital printing process and apparatus with improved printing results for various types of substrates, and in particular for substrates in which the carrier liquid is not absorbed, such as flexible substrates or labels used in the (food) packaging industry.

According to a first aspect there is provided a digital printing process for xerography printing with liquid toner. The liquid toner comprises a curable carrier liquid and imaging particles suspended in the carrier liquid. The process comprises the following steps: forming a latent image as a pattern of electric charge on a surface of an imaging member; transferring liquid toner onto a development member; developing the latent image by transferring liquid toner from the development member onto the imaging member in accordance with the pattern; transferring the liquid toner from the imaging member to a first substrate via optionally an intermediate member; applying a second substrate on the transferred liquid toner; and, after application of the second substrate, irradiating the liquid toner with actinic radiation or particle beams to cure the carrier liquid.

Applying a second substrate on the transferred liquid toner on the first substrate has a number of advantages. First, during the irradiating with actinic radiation or particle beams, the carrier liquid is trapped between the first and the second substrate, such that it is substantially sealed from the atmosphere. In that manner the curing can take place under substantially oxygen and water free conditions. In certain embodiments, the first and second substrates may be such that no carrier liquid is absorbed therein and that no oxygen can pass through the substrates. However, in other embodiments, e.g. in embodiments with a first and/or second substrate comprising a primer or coating layer on a substantially non-absorbing foil, small amounts of carrier liquid may be absorbed in the first and/or second substrate, e.g. in an adhesion promoting primer or coating layer thereof, but also in such embodiments the curing can take place under improved conditions thanks to the presence of the second substrate. Also, applying the second substrate may yield in a slight smoothening of the upper surface of the printed product. Further, by embedding the imaging particles in a cured layer of carrier liquid, the printed image may be better protected and/or the gloss may be improved. More in particular, the resulting printed product may be less sensitive to rubbing, may have a reduced sensitivity towards solvents and sunlight, and may have a smoother surface with an improved gloss. Compared to prior art solutions, embodiments of the invention have the advantage that very good printing results can be obtained without the need for applying a coating after printing.

Also, exemplary embodiments have the advantage that it is not necessary to perform fusing or evaporation after the transferring step. In that way the complete printing and crosslinking process can take place at lower temperatures compared to prior art processes avoiding thermal stress to be applied to the substrate and giving access to much thinner polymeric films (e.g. PE en PP).

Further, exemplary embodiments have the advantage that the resulting substrate, i.e. the substrate obtained after the curing step, no longer contains uncured carrier liquid. Especially for substrates used in the food packing industry this is beneficial in order to avoid food contamination with uncured carrier liquid.

In an exemplary embodiment the first substrate and the carrier liquid of the liquid toner are selected such that a layer of carrier liquid remains present on the first substrate after the step of transferring the liquid toner from the imaging member to the first substrate. In other words, the first substrate and the carrier liquid are selected such that either no carrier liquid is absorbed into the first substrate or that at least a layer of carrier liquid is not absorbed in the first substrate. In that manner the imaging particles are embedded in a cured layer of carrier liquid underneath the second substrate.

In an exemplary embodiment the curable carrier liquid is an electron beam-curable carrier liquid, and the irradiating step comprises irradiating the liquid toner with electron beams. The advantage of using electron beams is that the electron beams can penetrate over a certain depth in the layer to be cured. Further, using electron beams has the advantage that it is not necessary to include a photo-initiator in the carrier liquid, such that migration problems due to the presence of a photo-initiator or photo initiator fragments can be avoided. It is further noted that for some applications using UV is not possible, e.g. when the substrates are not permeable for the right wavelength. The irradiating may be done through the second substrate and/or through the first substrate. If the irradiating is done through the second substrate, in that case preferably a thin foil, the electron beams can penetrate through the second substrate, through the carrier liquid layer, into the first substrate, in order to cure at least the carrier liquid.

In an exemplary embodiment the first and/or the second substrate are transparent. By using a transparent first and/or second substrate, there is no need to remove the first or second substrate after curing, and the transparent first and/or the second substrate can be given suitable properties to improve the print result. In a possible embodiment the second substrate is transparent, and the irradiating takes place through the second substrate. In another embodiment the first substrate is transparent, and the irradiating takes place through the first substrate. In yet another embodiment the first and second substrate may be transparent and/or the irradiating may take place through the first and second substrate.

In an exemplary embodiment the second substrate and the carrier liquid are selected such that the second substrate adheres to the cured carrier liquid after the irradiating step. For example, a thin plastic foil, e.g. a PE, PP or polyester foil may be selected as the second substrate, and such foils generally adhere well to cured carrier liquids, see also the examples of suitable carrier liquids that are detailed below.

In an exemplary embodiment the first or the second substrate is non-transparent and irradiating takes place through the first and/or the second substrate. The non-transparent substrate can be for instance a metallic film in order to obtain advantageous print properties/effects of the final print.

Especially for flexible packaging materials, such metallic films are often used. More generally, because electron beam curing can also be done through non-transparent substrates, a higher flexibility in the choice of the first and second substrate is provided. If the printability for example is better on a transparent substrate one can print in reverse/mirror mode on the transparent first substrate, and use a non-transparent substrate as the second substrate, such that the image is visible through the first substrate. In other possible embodiments the first substrate and the second substrate may be non-transparent, and the second or first substrate may be removed after printing. If the first substrate is removed, printing is done in the reverse/mirror mode, while printing can be done in the normal mode if the second substrate is removed. When the second substrate is removed the surface pattern or surface roughness on the side thereof that is applied on the liquid toner can be used to control the gloss level on the final printed product (going e.g. from matt to satin and high gloss). Similarly, when the first substrate is removed, the side thereof on which the reverse/mirror image is printed may be provided with a suitable surface pattern or surface roughness to obtain a desired gloss level on the final printed product. In other words, in embodiments of the invention the surface roughness or surface pattern of the first or second substrate may be chosen to obtain a desired gloss level in the printed product. For example, when a high gloss is desirable a smooth surface can be chosen for the substrate that is removed. When a matt result is desirable a surface with a determined degree of surface roughness can be chosen for the substrate that is removed.

In an exemplary embodiment an additional amount of curable liquid is applied on the first substrate after the image formation and before application of the second substrate to improve the bonding of the first and the second substrate. In another exemplary embodiment an additional amount of curable liquid is applied on a side of the second substrate, whereupon the second substrate is applied on the first substrate, such that the side on which the additional curable liquid is applied is brought in contact with the transferred liquid toner on the first substrate. The addition can be done non image-wise, i.e. an even layer of curable liquid may be applied on the first substrate after the transferring step from the imaging member to the first substrate and/or on a side of the second substrate before applying the second substrate, for example by an anilox roller. In another embodiment the addition may be done image-wise, i.e. liquid may be applied according to a pattern on the first substrate and/or on a side of the second substrate before applying the second substrate, e.g. according to a pattern which is complementary to the pattern associated with the latent image, for example by an inkjet head. The image-wise addition of curable liquid may be advantageous especially on the non image parts where less curable liquid is present. An electrical bias can be applied during the addition of the curable liquid to avoid image disturbance. Indeed, by applying an electrical bias the imaging particles may remain fixed in their position on the first substrate. The additional liquid that is applied may be the same as the carrier liquid used during printing or may be a different curable liquid. In that regard it is noted that for the choice of the additional curable liquid one is not bound by the same constraints as for the carrier liquid that is used for printing e.g. in terms of viscosity and conductivity.

In an exemplary embodiment the irradiating is done through the second substrate and/or first substrate. The substrate with the best printability is preferably used as the first substrate.

In an exemplary embodiment the first substrate and the second substrate are provided as a continuous web during printing; and, during printing, the development member and the imaging member rotate continuously.

In an exemplary embodiment the first substrate and/or the second substrate comprises any one of the following: plastic film, metallic film, thermal paper, paper, and combinations thereof. The first and/or second substrate may have a multilayer structure. For example, the first or second substrate may be a substrate used for label printing. The invention is especially advantageous with first substrates S1 in which the carrier liquid is not absorbed (or only to a limited extent) such that the carrier liquid remains present on top of the first substrate S1. Examples of such first substrates are plastic or metallic films. Suitable plastics are e.g. polyvinyl chloride (PVC), polyvinylidene chloride (PVDC), polyester, polycarbonates, polyvinyl acetate, polyolefins and particularly polyethylenes (PE), like polyethylene of high density (HDPE), polyethylene of middle density (MDPE), linear polyethylene-middle density (LMDPE), polyethylene low-density (LDPE), linear low density polyethylene (LLDPE), and (biaxially oriented) polypropylene (PP). Examples of metallic films are foils containing any one of the following or a combination thereof: iron, steel, copper, aluminium and its alloys. Preferably a metallic film comprises a polymer film, e.g. a PP or PET film, coated with a thin layer of metal, preferably aluminium. Such metallic films offer the glossy metallic appearance of an aluminium foil at a reduced weight and cost. The second substrate S2 may be e.g. a polymer foil or metallic foils. Examples of suitable plastic foils are: PE foils, PP foils, polyester foils, etc. It is noted that it can also be envisaged to print on a thin foil as the first substrate, and to apply a thicker second substrate, wherein the irradiating then preferably takes place through the first substrate. However, in a possible embodiment the irradiating is done through the second substrate, and the second substrate is a plastic foil or metallic foil with a thickness between 10 and 75 micron and more preferably between 15 and 50 micron.

In an exemplary embodiment the imaging particles are any one of the following: chargeable colour pigments, chargeable coated colour pigments, chargeable toner particles with colour pigments, dyes.

In an exemplary embodiment the liquid toner is transferred from the imaging member to the first substrate either directly or via an intermediate member.

In an exemplary embodiment the carrier liquid comprises a radiation curable dispersing agent. In such an embodiment the dispersing agent can be cured together with the carrier liquid.

According to a second aspect there is provided a digital printing apparatus for xerography printing with liquid toner. The liquid toner used in said printing apparatus comprises a curable carrier liquid and imaging particles suspended in the carrier liquid. The digital printing apparatus comprises an image forming unit, a second substrate application unit, and a curing unit. The image forming unit comprises an imaging member adapted to sustain a pattern of electric charge forming a latent image on its surface, a development member arranged to receive liquid toner, and to develop said latent image by transferring said liquid toner onto said imaging member in accordance with said pattern, wherein the image forming unit is further configured to transfer the liquid toner from the imaging member to a first substrate. The second substrate application unit is configured to apply a second substrate on the transferred liquid toner on the first substrate. The curing unit is located downstream of the second substrate application unit, and the curing unit is configured to irradiate the transferred liquid toner with actinic radiation or particle beams to cure the carrier liquid.

In an exemplary embodiment the apparatus further comprises a first substrate feeding means configured to feed the first substrate as a continuous web during printing, and the second substrate application unit is configured to apply the second substrate as a continuous web during printing.

Also, the development member and the imaging member are preferably configured to rotate continuously during printing.

In an exemplary embodiment the apparatus further comprises a coating station for applying curable liquid on the first substrate between the image forming unit and the second substrate application unit. In another exemplary embodiment the apparatus further comprises a coating station for applying curable liquid on a side of the second substrate before the second substrate is applied on the first substrate and such that the side with additional curable liquid is brought in contact with the transferred liquid toner on the first substrate. The coating station can be configured to add the curable liquid image-wise, e.g. according to a pattern that is complementary to the pattern used by the image forming unit, or non image-wise, e.g. as an even layer. The coating station may comprise for example an anilox roller and/or one or more inkjet heads. The inkjet heads may be configured to apply curable liquid according to a controllable pattern, e.g. according to a pattern that is complementary to the pattern used by the image forming unit. The coating station may then comprises a controller configured to receive image data about the image to be printed by the image forming unit, and to control the inkjet heads based on the received image data. The curable liquid can be different from the curable carrier liquid or can be the same.

In an exemplary embodiment where the second substrate is not removed after curing, the apparatus further comprises a winding means configured for winding the resulting first substrate with the cured liquid toner and applied second substrate. Such an embodiment may potentially yield a fully functional high performing safe flexible packaging material that can be used safely for food materials.

In another exemplary embodiment where the second substrate is removed after curing, the apparatus further comprises a second substrate removal means downstream of the curing unit, and a first substrate winding means downstream of the curing unit, said second substrate removal means being configured to remove the second substrate after curing, and said first substrate winding means being configured for winding the first substrate with the cured liquid toner after removal of the second substrate. Preferably, the second substrate removal means comprises a second substrate reel spool for winding the removed second substrate.

In another exemplary embodiment where the first substrate is removed after curing, the apparatus further comprises a first substrate removal means downstream of the curing unit, and a second substrate winding means downstream of the curing unit, said first substrate removal means being configured to remove the first substrate after curing, and said second substrate winding means being configured for winding the second substrate with the cured liquid toner after removal of the first substrate. Preferably, the first substrate removal means comprises a first substrate reel spool for winding the removed first substrate.

In an exemplary embodiment the first substrate feeding means and/or the second substrate application unit comprises a spool reel with a substrate comprising any one of the following: plastic film, metallic film, thermal paper, paper and combinations thereof.

Preferably, the curing unit is an electron beam curing unit.

In an exemplary embodiment the image forming unit is configured to transfer the liquid toner from the imaging member to the first substrate either directly or via an intermediate member.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
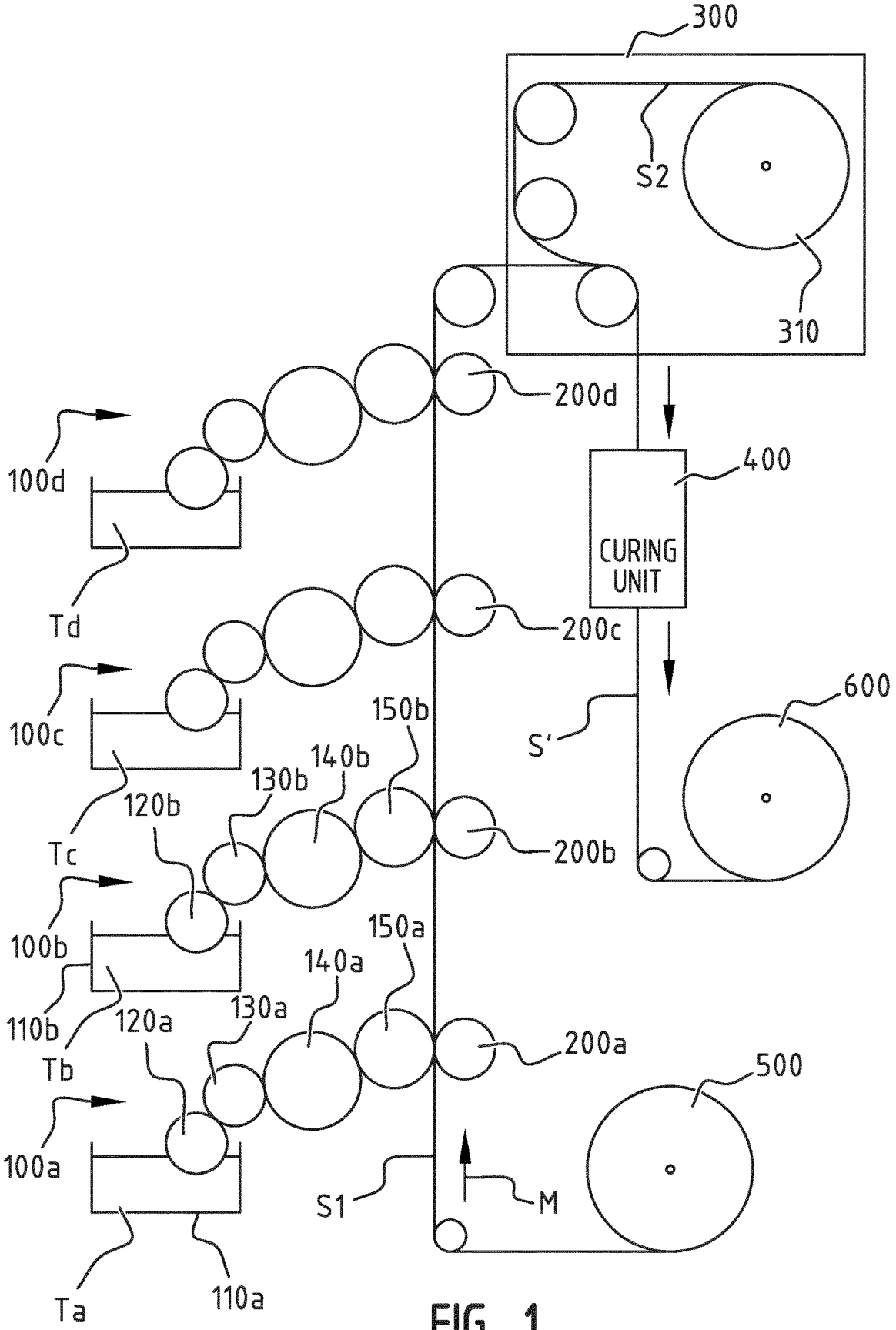
FIG. 1 is block diagram of an exemplary embodiment of a digital printing apparatus.

In electrophotographic processes operating with liquid toner (also called liquid toner dispersion), imaging particles (also called marking particles) are supplied as solid particles suspended in a carrier liquid. In embodiments of the invention a curable carrier liquid is used. The imaging particles may be chargeable colour pigments, chargeable coated colour pigments, chargeable toner particles with colour pigments, dyes. Toner particles comprise pigment grains, typically embedded in a small bead of resin. A dispersing agent, also called dispersant is added to the mix to avoid clustering of the imaging particles. Dispersants deflocculate the imaging particles and reduce the viscosity of the liquid toner dispersion.

The curable carrier liquid in a liquid toner according to the present invention can be any suitable liquid having the desired conductivity and viscosity characteristics and capable of becoming cured to form a solid. The curable carrier liquid has typically a conductivity lower than 50 pS/cm, more preferably lower than 20 pS/cm and even more preferable lower than 5 pS/cm. Further, the liquid carrier must be capable of permitting the imaging particles of the liquid toner to migrate through the carrier liquid to develop electrostatic latent images.

Typical carrier liquids suitable as the curable liquid vehicle include ethylenically unsaturated compounds, including monomers, dimers, or oligomers having one or more ethylenically unsaturated groups such as vinyl or allyl groups, and polymers having terminal or pendant ethylenic unsaturation. Examples of suitable curable liquids include, but are not limited to, acrylate and methacrylate monomers or polymers containing acrylic or methacrylic group(s). Also suitable are epoxy monomers or epoxy containing polymers having one or a plurality of epoxy functional groups. Further examples of suitable curable materials include vinyl ether monomers, oligomers, or polymers containing vinyl ether groups. Also suitable are internal or terminal alkenes and polyenes, fatty acid mono-, di-, tri- and polyesters based on unsaturated fatty acids and/or unsaturated alcohols and alkyl carbonates based on unsaturated alcohols. Depending on the functionality of the curable carrier liquid (number of double bounds) the bonding strength and flexibility of the print with cured carrier liquid can be adjusted.

In an exemplary embodiment the curable carrier liquid is an isostearyl acrylate.

Other examples of curable carrier liquids are Ebecryl® and UceCoat® from Allnex, Radia®, Radiasolve®, Radiasurf® and Radiamuls® from Oleon and Alpha Olefins from Ineos Oligomers.

In electrophotographic processes liquid toner (also called liquid toner dispersion) is a dispersion of marking particles in a carrier liquid. In other words the toner particles are substantially undissolved in the carrier liquid. The marking particles may comprise coloured particles (also called ink particles or pigment) and a binder resin although non-pigmented resin systems also can be used containing e.g. a phosphor or taggant or UV active material. Typically, the diameter of the marking particles is about 0.5 to 4.0 μm. The marking particles have a concentration of about 40-95% of binder resin. The binder resin is a polymer, preferably transparent, that embeds the ink particles. Preferably, a polyester resin is used as binder resin. Also other types of resin having a very low or no compatibility with the carrier liquid and dispersing agent can be used. Preferably, the resin has a high transparency and provides good colour developing properties. The coloured particles and other optional components of the marking particles such as wax, plasticizer or other additives may be embedded in the binder resin. The marking particles may be extrudates of the binder resin and the coloured particles.

In some embodiments, the marking particles may be curable marking particles, preferably marking particles curable by a particle beam such as an electron beam.

The carrier liquid may further contain variable amounts of charge control agent (CCA), wax, plasticizers, and other additives, although they also can be incorporated into the imaging particle itself. The carrier liquid may be volatile or non-volatile. Typically, the toner liquid may have a solid concentration between 5% and 60 wt %. The high-shear viscosity, as measured at a shear rate of 3000 s−1 at 25° C. with a cone plate geometry of C60/1° and a gap of 52 μm, is preferably in the range of 5-500 mPa·s.

FIG. 1 illustrates schematically an exemplary embodiment of a digital printing apparatus using liquid toner. The apparatus comprises a first image forming unit 100*a* for applying liquid toner Ta having a first colour, e.g. black, onto a first substrate S1, a second image forming unit 100*b* for applying liquid toner Tb having a second colour, e.g. cyan, onto the first substrate S1, a third image forming unit 100*c* for applying liquid toner Tc having a third colour, e.g. magenta, onto the first substrate S1, and a fourth image forming unit 100*d* for applying liquid toner Td having a fourth colour, e.g. yellow, onto the first substrate S1.

The first image forming unit 100*a* comprises a toner reservoir 110*a*, a feed member 120*a*, a first development member 130*a*, a first imaging member 140*a*, and an optional intermediate member 150*a*. The first imaging member 140*a* is adapted to sustain a first pattern of electric charge forming a first latent image on its surface. The first development member 130*a* is arranged to receive first liquid toner Ta from the feed member 120*a*, and to develop said first latent image by transferring a portion of said first liquid toner Ta onto first imaging member 140*a* in accordance with said first pattern. Similarly, the second image forming unit 100*b* comprises a toner reservoir 110*b*, a feed member 120*b*, a second development member 130*b*, a second imaging member 140*b*, and an optional intermediate member 150*b*. The second imaging member 140*b* is adapted to sustain a second pattern of electric charge forming a second latent image on its surface. The second development member 130*b* is arranged to receive second liquid toner Tb from the feed member 120*b*, and to develop said second latent image by transferring a portion of said second liquid toner Tb onto second imaging member 140*b* in accordance with said second pattern. The third and fourth imaging member 100*c*, 100*d* may be implemented in a similar manner.

The first substrate S1 is supported on a substrate support assembly which comprises in the illustrated embodiment first, second, third and fourth support members 200*a*, 200*b*, 200*c*, 200*d* for supporting the first substrate S1 during the subsequent transfer of first, second, third and fourth liquid toner Ta, Tb, Tc, Td from the first, second, third and fourth image forming unit 100*a*, 100*b*, 100*c*, 100*d*, respectively, whilst the first substrate S1 moves in a movement direction M from the first image forming unit 100*a* to the fourth image forming unit 100*d*.

In the development stage, imaging particles travel from a development member 130*a* supplied with a thin, film-like layer of liquid toner Ta, onto the imaging member 140*a* that carries the first latent image. In a subsequent step, the developed first latent image is transferred from the imaging member 140*a* onto the intermediate member 150*a*. In the final transfer step, the developed image is transferred from the intermediate roller 150*a* onto the first substrate S1, which is supported by the support roller 200*a* that may be kept at a suitable potential. Similar development stages apply for the second, third and fourth image forming units 100*b*, 100*c*, 100*d*.

Throughout the application, the various stages of the image forming units 100*a*, 100*b*, 100*c*, 100*d* and of the support assembly 200*a*, 200*b*, 200*c*, 200*d* have been described as members. These members may be rotating rollers, but the skilled person will appreciate that the same principles may be applied with other members, e.g. comprising a suitably designed rotating belt with a roll and/or a belt tracking shoe.

Figure 3A:
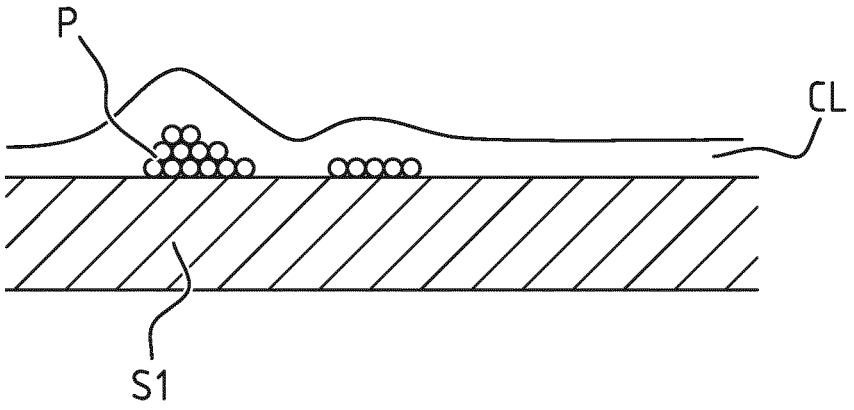
FIGS. 3A and 3B illustrate schematically a cross section of a printed image before and after a foil S2 is applied, respectively.

This process results in a thin layer of liquid toner being applied to the first substrate S1, see FIG. 3A. When four colours are printed the thickness of the liquid toner layer on the first substrate is typically between 0.5 and 15 micron. For example, in areas where an image with four colours is printed the thickness may be approximately 11 to 13 micron, in areas where no image is present the thickness may be approximately 0.5 to 2 micron, and in areas with an image with one colour the thickness may be approximately 3 to 5 micron.

The digital printing apparatus further comprises a second substrate application unit 300 configured to apply a second substrate S2, e.g. a foil, on the transferred liquid toner on the first substrate S1, and a curing unit 400 configured to irradiate the transferred liquid toner through said second substrate S2 and/or through the first substrate S1 with actinic radiation or particle beams to cure the carrier liquid on and/or in the first substrate S1. When the first substrate S1 does not absorb the carrier liquid, the carrier liquid on the first substrate S1 is cured. When the first substrate S1 partially absorbs the carrier liquid, the carrier liquid on and in the first substrate S1 is cured. Also, when the carrier liquid is partially absorbed in the second substrate S2, the carrier liquid in the second substrate S2 is cured. In other words, preferably the resulting substrate S' (i.e. the first substrate S1 with the printed image beneath second substrate S2) does not contain any uncured carrier liquid.

It is noted that the first substrate S1 and/or the second substrate S2 may be transparent. For example, the first substrate S1 may be a non-transparent substrate and the second substrate S2 may be a transparent film. In this example the irradiating is preferably done through the second substrate S2. However, it is also possible to print on a thin transparent first substrate S1 and to irradiate through the first substrate S1. In such an embodiment the second substrate S2 may be non-transparent. In yet another embodiment the first substrate S1 may be a transparent substrate, and the second substrate S2 may be a non-transparent substrate, i.e. non-transparent for visible light but transparent for the radiation of electron beams used.

Figure 3B:
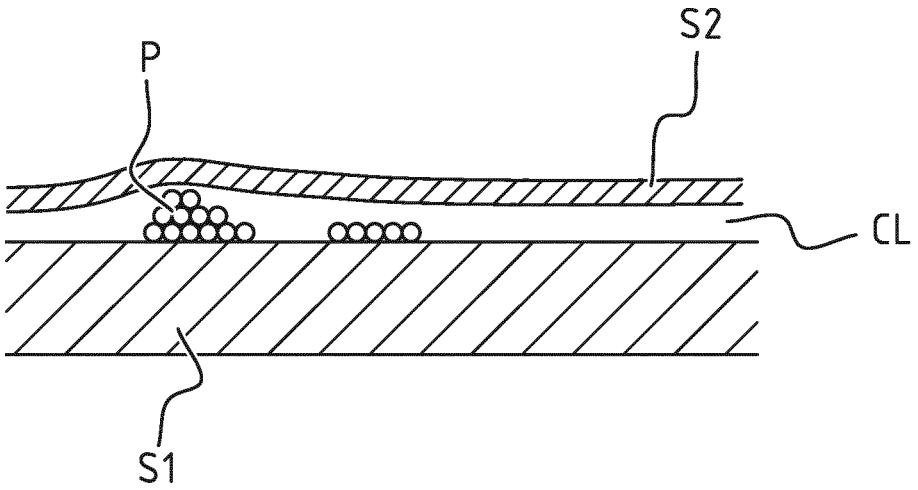

The second substrate application unit 300 is arranged downstream of the image forming units 100*a*, 100*b*, 100*c*, 100*d*. FIG. 3A shows the first substrate S1 on which a layer of carrier liquid CL containing imaging particles P has been applied, and FIG. 3B shows the first substrate S1 downstream of the second substrate application unit 300, after a second substrate S2 has been applied over the layer of carrier liquid CL. Applying a second substrate S2 may cause a slight smoothening of the upper surface of the layer of carrier liquid CL.

The curing unit 400 is preferably an electron beam (EB) curing unit. EB penetration depends amongst others upon the mass density and thickness of the material. EB curing has the advantage that electrons are substantially "color blind" and that penetration is not affected by pigments and opaque substrates. This has also the advantage that EB curing can take place through a non-transparent substrate, for example a metallic foil. An EB curing unit typically comprises electrically operated filaments and grids contained within a vacuum chamber. The electrons are accelerated through a window/foil structure to reach the area to be cured at atmospheric pressure. In an embodiment of the invention low-voltage EB equipment operating from about 70 to 125 kV may be used for most applications. EB penetration may be controlled by varying the accelerating potential (voltage) of the EB curing unit. If the first substrate S1 does not absorb the carrier liquid, preferably, the control is such that the penetration in the first substrate S1 itself is limited. However, the effect of the electron beams on the first substrate S1 may in certain embodiments be beneficial. E.g. cross-linking may enhance the properties of some polyethylene based substrates. Also, EB-induced ionization of the substrate surface may result in enhanced adhesion. Electron beams can also potentially be used for simultaneous curing of the carrier liquid and surface sterilization of the substrates S1, S2. Such embodiments may be useful for food packaging materials.

Embodiments of the invention have the advantage that the fusing step which is typically applied downstream of the image forming units 100*a*, 100*b*, 100*c*, 100*d* may be omitted. In that way it is avoided that the substrate is heated up to a high temperature since the curing by the curing unit 400 can be performed at lower temperatures. However, it is still possible to perform a fusing step downstream of the image forming units 100*a*, 100*b*, 100*c*, 100*d*, before or after the second substrate application unit 300, e.g. to enhance the mixing of imaging particles of different colors.

Particular embodiments of the invention relate to the field of digital printing apparatus and processes for so-called "continuous" webs, i.e. printing systems where a continuous roll of substrate is run through the printer, in particular to print large numbers of copies of the same image(s), or alternatively, series of images, or even large sets of individually varying images. The digital printing apparatus comprises to that end a first substrate feeding means 500 configured to feed the first substrate S1 as a continuous web during printing. Further the second substrate application unit 300 may be configured to apply the second substrate S2 as a continuous web during printing. The resulting substrate S' with the printed image beneath second substrate S2 may then be rolled on a roll 600.

Figure 2:
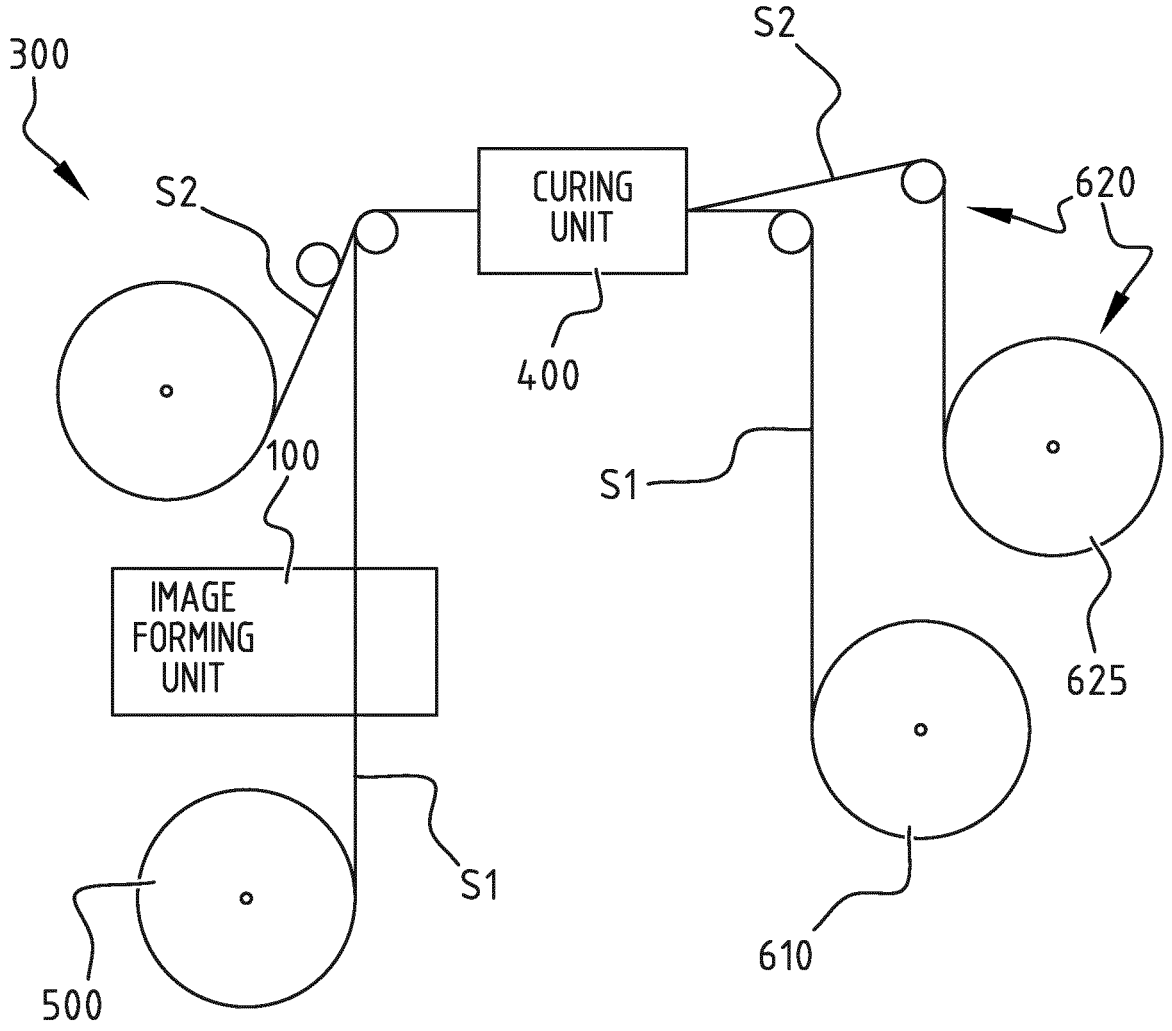
FIG. 2 is block diagram of another exemplary embodiment of a digital printing apparatus.

FIG. 2 illustrates another exemplary embodiment of a digital printing apparatus of the invention in which components similar to the components of the embodiment of FIG. 1 have been indicated with the same reference numerals. The digital printing apparatus comprises a first substrate feeding means 500 for feeding a first substrate S1, an image forming unit 100 for forming a printed image by transferring liquid toner on the first substrate S1, a second substrate application unit 300 configured to apply a second substrate S2, e.g. a foil, on the transferred liquid toner on the first substrate S1, and a curing unit 400 configured to irradiate the transferred liquid toner through said second substrate S2 and/or through the first substrate S1 with actinic radiation or particle beams to cure the carrier liquid on and/or in the substrate S1. The digital printing apparatus of FIG. 2 further comprises a second substrate removal means 620 downstream of the curing unit 400, and a first substrate winding means 610 downstream of the curing unit 400. The second substrate removal means 620 is configured to remove the second substrate S2 after curing. The first substrate winding means 610 is configured for winding the first substrate S1 with the cured liquid toner after removal of the second substrate S2 by the second substrate removal means 620. The second substrate removal means 620 comprises a second substrate reel spool 625 for winding the removed second substrate S2. In such an embodiment the first substrate S1 and the second substrate S2 may be opaque. If the irradiating is performed through the second substrate S2, the second substrate S2 may be opaque as long as it allows the used actinic radiation or particle beams to pass through.

Preferably the first substrate S1 comprises any one of the following: plastic film, metallic film, thermal paper, paper, and combinations thereof. The first substrate S1 may also have a multilayer structure. The invention is especially advantageous with first substrates S1 in which the carrier liquid is not absorbed (or only to a limited extent) such that the carrier liquid remains present on top of the first substrate S1. Examples of such first substrates are plastic or metallic films. Suitable plastics are e.g. polyvinyl chloride (PVC), polyvinylidene chloride (PVDC), polyester, polycarbonates, polyvinyl acetate, polyolefins and particularly polyethylenes (PE), like polyethylene of high density (HDPE), polyethylene of middle density (MDPE), linear polyethylene-middle density (LMDPE), polyethylene low-density (LDPE), linear low density polyethylene (LLDPE), and (biaxially oriented) polypropylene (PP). Examples of metallic films are foils comprising any one or more of the following: iron, steel, copper, aluminium and its alloys. Preferably, a metallic film comprises a polymer foil on which a metal coating is applied.

In an exemplary embodiment where the second substrate S2 is not removed, the first substrate S1 may be non-transparent and the second substrate S2 may be transparent. However it is also possible to apply a (removable) non-transparent foil as the second substrate S2. If the second substrate S2 has to be transparent, preferably a polymer foil is chosen. Examples of suitable plastic foils are: PE foils, PP foils, polyester foils, etc. In such an embodiment the irradiating is preferably done through the second substrate S2, and the second substrate S2 is then preferably thin, e.g. between 15 and 50 micron. Alternatively the printing may be performed on a thin first substrate S1 and the irradiating may be performed through the first substrate S1.

Figure 4:
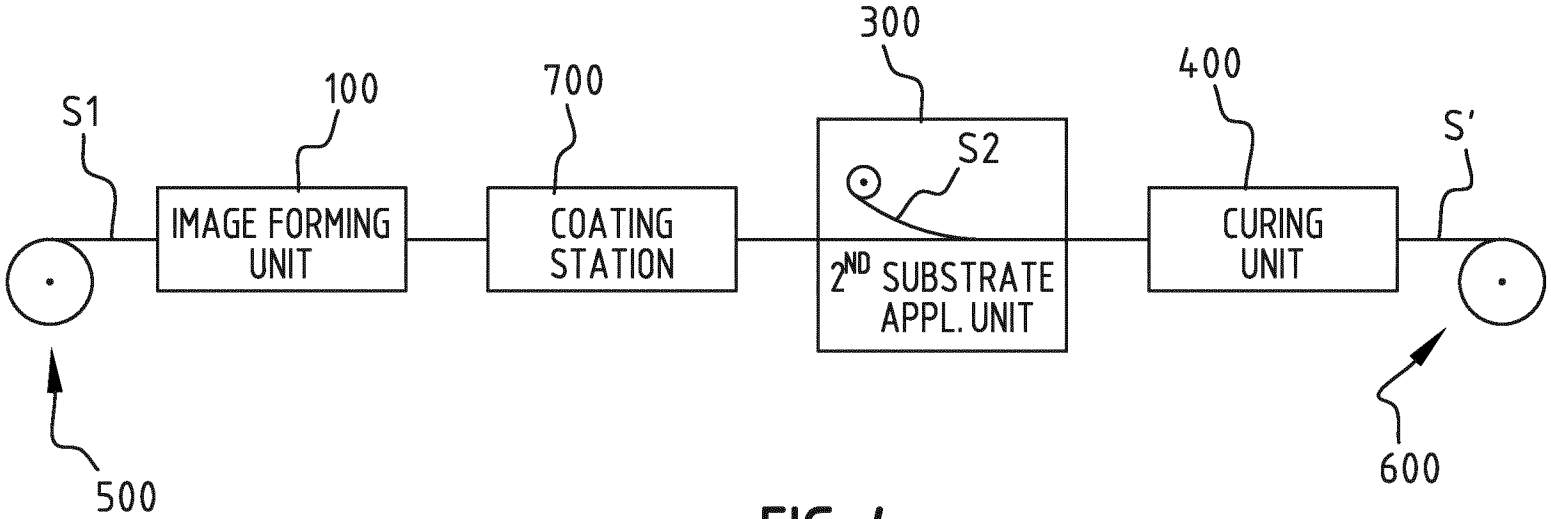
FIG. 4 illustrates a block diagram of another exemplary embodiment of a digital printing apparatus.

FIG. 4 illustrates another exemplary embodiment of a digital printing apparatus of the invention in which components similar to the components of the embodiment of FIGS. 1 and 2 have been indicated with the same reference numerals. The digital printing apparatus comprises a first substrate feeding means 500 for feeding a first substrate S1, an image forming unit 100 for forming a printed image by transferring liquid toner on the first substrate S1, a coating station 700 configured for applying additional curable liquid, a second substrate application unit 300 configured to apply a second substrate S2 on the transferred liquid toner on the first substrate S1, and a curing unit 400 configured to irradiate the transferred liquid toner through said second substrate S2 and/or through the first substrate S1 with actinic radiation or particle beams to cure the carrier liquid on and/or in the first substrate S1, and a substrate winding means 600 downstream of the curing unit 400, for winding the resulting substrate S'. When the first substrate S1 does not absorb the carrier liquid, the carrier liquid on the first substrate S1 is cured. When the first substrate S1 partially absorbs the carrier liquid, the carrier liquid on and in the first substrate S1 is cured. Also, when the carrier liquid is partially absorbed in the second substrate S2, the carrier liquid in the second substrate S2 is cured. In other words, preferably the resulting substrate S' does not contain any uncured carrier liquid. In an exemplary embodiment the apparatus further comprises a coating station for applying curable liquid on the first substrate between the image forming unit and the second substrate application unit. The coating station 700 can be configured to add the curable liquid image-wise, e.g. according to a pattern that is complementary to the pattern used by the image forming unit, or non-image-wise, e.g. as an even layer. The coating station 700 may comprise for example an anilox roller and/or one or more inkjet heads. The inkjet heads may be configured to apply curable liquid according to a controllable pattern, e.g. according to a pattern that is complementary to the pattern used by the image forming unit. To that end there may be provided a controller (not shown) configured to receive image data about the image to be printed by the image forming unit 100, and to control the inkjet heads based on the received image data.

The skilled person understands that also in the embodiment of FIG. 2, it may be envisaged to add a coating station 700 between the image forming unit 100 and the second substrate application unit 300. In yet another embodiment (not shown) the coating station 700 may be used to apply a curable liquid on the bottom side of the second substrate S2, whereupon the second substrate S2 may be applied with its coated bottom side against the printed image on the first substrate S1.

While the invention has been described hereinabove with reference to specific embodiments and examples, this is done to illustrate and not to limit the invention. The skilled person will appreciate that other ways of implementing the inventive concept described herein are within the scope of the invention, as defined by the accompanying claims.

The invention claimed is:

1. A digital printing process for xerography printing with liquid toner, said liquid toner comprising a curable carrier liquid and imaging particles suspended in the curable carrier liquid, wherein said process comprises:

forming a latent image as a pattern of electric charge on a surface of an imaging member;

transferring the liquid toner onto a development member;

developing the latent image by transferring liquid toner from the development member onto the imaging member in accordance with the pattern;

transferring the liquid toner from the imaging member to a first substrate;

applying a second substrate on the transferred liquid toner;

after application of the second substrate, irradiating the liquid toner with actinic radiation or particle beams to cure the curable carrier liquid.

2. The process of claim 1, wherein the first substrate and the curable carrier liquid are selected such that a layer of the curable carrier liquid remains present on the first substrate after the step of transferring the liquid toner from the imaging member to the first substrate.

3. The process of claim 1, wherein the curable carrier liquid is an electron beam-curable carrier liquid, and the irradiating step comprises irradiating the liquid toner with electron beams.

4. The process of claim 1, wherein the first and/or the second substrate are transparent.

5. The process of claim 1, wherein the second substrate and the curable carrier liquid are selected in such a way that both the first and the second substrate adhere to the cured carrier liquid after the irradiating step.

6. The process of claim 1, wherein the second or the first substrate is removed from the cured carrier liquid after the irradiating step.

7. The process of claim 6, wherein the second or first substrate that is being removed is chosen to be a substrate with a predetermined surface roughness or surface pattern on the side that is in contact with the transferred liquid toner, such that the removal of said substrate creates a complementary surface roughness or surface pattern at a top surface of the cured carrier liquid.

8. The process of claim 1, wherein the irradiating is done through the second substrate and/or through the first substrate.

9. The process of claim 1, wherein the first substrate and the second substrate are provided as a continuous web during printing; and wherein, during printing, the development member and the imaging member are continuously rotating members.

10. The process of claim 1, wherein the first substrate and the second substrate comprises any one of the following: plastic film, metallic film, thermal paper, paper, and combinations thereof.

11. The process of claim 1, wherein the first or second substrate is a plastic foil.

12. The process of claim 1, wherein the imaging particles are any one of the following: chargeable colour pigments, chargeable coated colour pigments, chargeable toner particles with colour pigments or dyes.

13. The process of claim 1, wherein the liquid toner is transferred from the imaging member to the first substrate either directly or via an intermediate member.

14. The process of claim 1, wherein the curable carrier liquid comprises a radiation curable dispersing agent.

15. The process of claim 1, further comprising applying additional curable liquid:

on the first substrate after the step of transferring from the imaging member to the development member, and before the step of applying the second substrate; and/or on a side of the second substrate before the second substrate is applied on the first substrate and such that the side is brought in contact with the transferred liquid toner on the first substrate.

16. The process of claim 15, wherein the applying of additional curable liquid is done in accordance with a coating pattern which is substantially complementary to the pattern used in the developing step to control a thickness of the liquid layer on the first substrate to be substantially the same in all areas of the first substrate.

17. A digital printing apparatus for xerography printing with liquid toner, wherein the liquid toner used in said printing apparatus comprises a curable carrier liquid and imaging particles suspended in the curable carrier liquid, and wherein said apparatus comprises:

an image forming unit comprising an imaging member adapted to sustain a pattern of electric charge forming a latent image on its surface, a development member arranged to receive liquid toner, and to develop said latent image by transferring said liquid toner onto said imaging member in accordance with said pattern, wherein the image forming unit is further configured to transfer the liquid toner from the imaging member to a first substrate;

a second substrate application unit configured to apply a second substrate on the transferred liquid toner on the first substrate;

a curing unit downstream of the second substrate application unit, said curing unit being configured to irradiate the transferred liquid toner with actinic radiation or particle beams to cure the curable carrier liquid.

18. The apparatus of claim 17, further comprising a first substrate feeding means configured to feed the first substrate as a continuous web during printing, wherein the second substrate application unit is configured to apply the second substrate as a continuous web during printing, and wherein the imaging member and the development member are configured to rotate during printing.

19. A digital printing process for xerography printing with liquid toner, said liquid toner comprising an electron beam curable carrier liquid and imaging particles suspended in the electron beam curable carrier liquid, wherein said process comprises:

forming a latent image as a pattern of electric charge on a surface of an imaging member;

transferring the liquid toner onto a development member;

developing the latent image by transferring liquid toner from the development member onto the imaging member in accordance with the pattern;

transferring the liquid toner from the imaging member to a first substrate;

applying a second substrate on the transferred liquid toner;

after application of the second substrate, irradiating the liquid toner with electron beams to cure the electron beam curable carrier liquid, wherein the first and/or the second substrate are transparent.

20. The process of claim 19, wherein the first substrate and the electron beam curable carrier liquid are selected such that a layer of the electron beam curable carrier liquid remains present on the first substrate after the step of transferring the liquid toner from the imaging member to the first substrate.

* * * * *